US005674551A

United States Patent [19]

Koskinen et al.

[11] Patent Number: 5,674,551

[45] Date of Patent: Oct. 7, 1997

[54] METHOD AND APPARATUS FOR COATING A MOVING PAPER WEB

[75] Inventors: Jukka Koskinen, Järvenpää ; Vilho Nissinen, Numminen, both of Finland

[73] Assignee: Valmet Corporation, Helsinki, Finland

[21] Appl. No.: 560,826

[22] Filed: Nov. 20, 1995

[51] Int. Cl.[6] ..... B05D 3/12; B05C 11/04

[52] U.S. Cl. ..... 427/8; 427/172; 427/356; 118/672; 118/33; 118/126

[58] Field of Search ..... 427/8, 172, 356, 427/358; 118/672, 33, 123, 126, 413

[56] References Cited

U.S. PATENT DOCUMENTS

| | | | |
|---|---|---|---|
| 2,249,088 | 7/1941 | Murray . | |
| 2,252,345 | 8/1941 | Johnson . | |
| 2,312,927 | 3/1943 | Murray . | |
| 2,711,156 | 6/1955 | Bauling . | |
| 3,019,130 | 10/1962 | Hornbostel . | |
| 3,088,842 | 5/1963 | Kuhnel . | |
| 3,863,597 | 2/1975 | Anselrode | 118/126 |
| 3,870,778 | 3/1975 | Steel | 264/164 |
| 4,041,197 | 8/1977 | Gagné | 427/278 |
| 4,416,922 | 11/1983 | Fridhandler | 427/361 |
| 4,856,454 | 8/1989 | Sieberth et al. . | |
| 4,973,441 | 11/1990 | Keller | 264/280 |
| 5,104,697 | 4/1992 | Heikkinen et al. | 427/356 |
| 5,112,653 | 5/1992 | Damarau et al. | 427/356 |

FOREIGN PATENT DOCUMENTS

| | | | |
|---|---|---|---|
| 0 436 172 A1 | 7/1991 | European Pat. Off. . | |
| 2272850 | 6/1994 | United Kingdom | 118/126 |

*Primary Examiner*—Katherine A. Bareford

*Attorney, Agent, or Firm*—Cohen, Pontani, Lieberman & Pavane

[57] ABSTRACT

A method and apparatus for coating a moving paper or cardboard web, in which the moving web is brought to a first backing roll and coating mix is metered onto the web by means of a pre-doctoring blade in the form of a high-velocity laminar flow in front of the pre-doctoring blade. The applied coating mix is smoothed evenly onto the web with the pre-doctoring blade and the coated web is brought to a second backing roll, where the applied coating mix is smoothed using a doctor blade working on the web supported by the second backing roll. The tension of the web is measured upstream from the first backing roll and the rotational speed of the second backing roll is set so that the tension of the web is set at a desired value. The rotational speed of the first backing roll is set so that a speed difference between the first and the second backing roll compensates for elongation of the web caused by wetting between the first and second backing rolls.

12 Claims, 2 Drawing Sheets

METHOD AND APPARATUS FOR COATING A MOVING PAPER WEB

FIELD OF THE INVENTION

The present invention relates to a method and apparatus for coating moving paper or cardboard webs with an even layer of coating mix.

BACKGROUND OF THE INVENTION

In modern paper making technology several different coating methods are used. Typically, the coating mix is first spread on the web by a suitable application method and excess coating is then scraped away. The surface of the coating is smoothed by means of a scraper. The most commonly used applicators include roll applicators, inverted blade or nozzle applicators, and short-dwell applicators. The coating mix is usually smoothed using a doctor blade, a doctor bar or an air knife.

In U.S. Pat. Nos. 5,112,653 and 5,104,697, a coater station is described which comprises a short-dwell applicator unit and a doctor blade, both working on a single backing roll. Particularly in this kind of coater stations equipped with a nozzle or blade applicator and having the coating mix metered onto the web by means of a blade, certain operating conditions result in runnability problems of the web being coated because the applicator and the doctor blade form two linear fixing points of the web onto a single backing roll. Air conveyed along with the surface of the paper web remains pocketed between the web and the backing roll in the area delimited by these two web fixing points. Then, an irregularly shaped air pouch called "blowing" can develop in the area between the two web fixing points due to, for example, an uneven distribution of web tension. The forces exert either a web braking or pulling effect at the web fixing points, thereby allowing the web to slacken in the area between these two web fixing points. Furthermore, because the web moisture content increases during the application of the coating mix, the web tends to swell between the web fixing points, thereby causing additional slackening of the web.

Due to uneven tension, thickness, porosity or other profile across the web, web slackening occurs irregularly across the web within the area between the web fixing points. These conditions may result in web curling in the machine direction and possibly in creasing of the web.

In addition, the backing roll of the applicator disclosed in U.S. Pat. No. 5,112,653 has to be a soft roll so that it can compensate for uneven wear of the blade. However, soft rolls are usually covered with a robber layer and are typically more expensive than hard steel rolls. Also, cleaning of such soft rolls is more difficult and expensive because they cannot be cleaned with a doctor blade. Furthermore, in the applicator unit of this device, it is essential to maintain a significant pressure on the application zone. This is achieved by effectively sealing the application zone to prevent leaks, especially at the end of the zone. Also, a large overflow of coating mix is typically pumped into the application zone to prevent any entry of air into the application zone with the travelling web. Typically, about 3 or 4 times the mount of coating mix to be applied onto the web is pumped into the application zone to prevent entry of air into the application zone.

In U.S. Pat. No. 4,856,454, an applicator mechanism is described featuring an applicator roll which receives the coating mix from a coating mix sump or a transfer roll and an opposed backing roll, with the applicator roll and the backing roll forming a gap for metering coating mix onto the web passing through this gap. Downstream of the applicator roll is a second backing roll and a doctor blade, which is used for final smoothing of the coating layer applied to the web. A reversing roll, located between the first and the second backing rolls, causes a relatively uniform dumping of at least part of the coating mix. However, in this apparatus, the applicator roll causes severe splashing at higher web speeds. In the devices described above, different kinds of short dwell applicators have been suggested for use rather than an applicator roll to overcome the splashing problem.

In devices comprising two backing rolls, web tension between the rolls is maintained by controlling the speed difference between the two rolls. Normally, the tension of the web between the backing rolls is measured, and the tension of the web is maintained by torque moment control of the mils. Increase in the torque moment of the second roll increases its rotational speed, whereby the tension of the web is increased. Decrease in the torque moment of the first roll has the same effect. The measurement of the web tension can, for example, be arranged with a combined tension measurement and spreading roll. A coating apparatus of this kind is described in Finnish patent application No. 93,665. In this apparatus, coating mix is applied to a paper web using an applicator unit which forms a linear mechanical force on the web against a backing surface situated on the back side of the web, and the coating mix applied to the web is doctored using a doctor unit acting against a backing surface. The application of the coating mix takes place backed by a first backing surface, and the coating mix is doctored backed by a second backing surface. The speed of at least one of the backing surfaces is independently controlled relative to the speed of the other backing surface and the web to attain control of the tension of the web. However, Finnish patent application no. 93,665 fails to provide a method for determining the appropriate speed difference between the rolls.

SUMMARY OF THE INVENTION

According to the present invention, the coating mix is applied to a moving web with a short dwell applicator backed by a first backing roll. The mix is smoothed and levelled on the web with a doctor blade, downstream of the applicator unit and backed by a second backing roll. The tension of the web between the backing rolls is controlled such that the speed difference between these backing rolls and the speed difference compensates for elongation of the web caused by wetting.

Different kinds of paper and cardboard have different wetting properties and the elongation caused by wetting is specific to each paper or cardboard quality. The elongation can be determined for each type of web. When the elongation factors are known, the speed difference of the backing rolls can be set to compensate for elongation of the web between the rolls. In practice, when a coating station is being built, the elongation specific to each product to be produced is determined experimentally, and these values are used to determine the effect of web wetting and the required speed differences of the backing rolls during actual production. These experimental values are used to determine a function for calculating the speed difference under different production conditions.

According to the other aspects of the present invention, the applicator unit is a nozzle applicator as described in U.S. Pat. No. 5,104,697. The coating mix is applied to the web as a laminar flow that travels under a pre-smoothing blade having a tip inclination angle which is equal to or less than 20°. When this applicator unit is used, it is not necessary to use a soft backing roll and instead the first backing roll may be a hard steel roll.

When the tension of the web is controlled according to the present invention, tension measurement between the backing rolls is not needed, and the apparatus is much smaller and less complex. When the speed differences for different kinds of paper have been determined, setting the speed values for different web qualities is easy and no complex control devices and circuitry are needed. The use of an inverted blade applicator makes it possible to use a steel backing roll instead of a soft backing roll. Hard steel rolls are less expensive and easier to clean than soft rolls. Also, in using an inverted blade applicator, the pressure required in the application zone is low, and expensive and complex seals are not needed. Excess coating mix can flow easily from the application zone, and the exit angle of the web from the first backing roll can be small.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
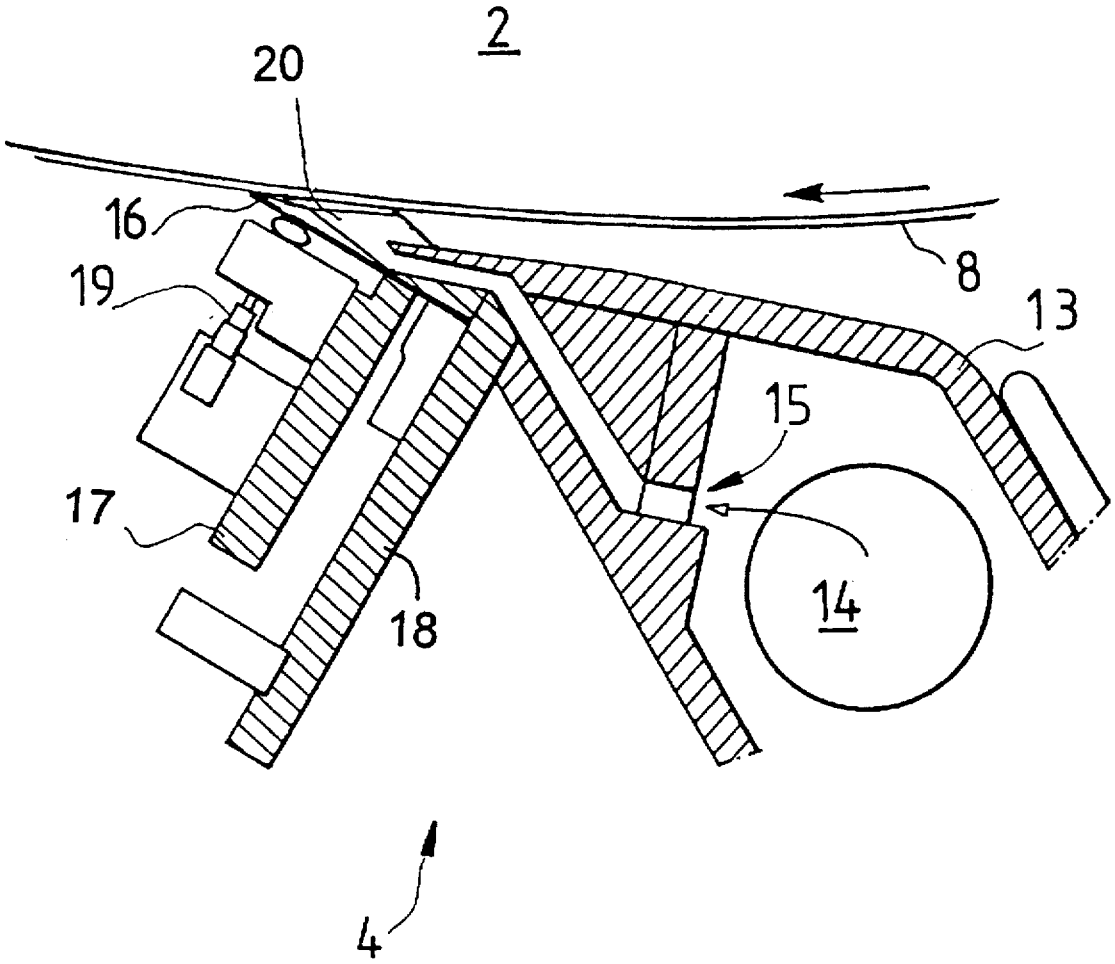
FIG. 1 is a shows the preferred applicator apparatus of the present invention.

The inverted blade metering unit illustrated in FIG. 1 comprises a backing roll 2, its rotational direction being indicated by an arrow, which is closely covered by the paper web 8 being coated. Extending across the width of the web 8 and under the backing roll 2, a blade metering or applicator unit 4 is placed, its frame being formed by a support beam 13. The coating mix is fed through a cross-directionally aligned feed channel 14, mounted onto the support beam 13 on the entrance side of the web 8, into a cavity-like space, wherefrom the coating mix travels under pressure into a narrow feed channel 15. As can be seen from FIG. 1, the feed channel 15, sectioned in the plane of the flow vector of the coating mix, is substantially S-shaped. The feed channel 15 exits to the stem part of a pre-doctoring blade 16. The feed channel 15, which is extremely narrow compared to conventional feed channels, preferably has an exit opening with a height of only about 3 to about 5 mm. The pre-doctoring blade 16 is fixed at its stem between blade holders 17 and 18. The blade 16 leans flexibly on the web 8 at an obtuse angle. The tip inclination angle of the blade 16 relative to the web's lower surface is typically less than about 20°, preferably less than about 15°. The width of the application zone is limited with seals 20.

The blade holders 17 and 18 are implemented so as to avoid forming any significant step between the exit opening of the feed channel 15 and the stem of the blade 16. In particular, the blade holder 18 facing the blade 16 on the side of the feed channel side 15 has a wedge-shaped cross section tapering toward the tip of the blade 16. The blade 16 is mounted in this manner so as to maintain a laminar flow pattern of the mix exiting the feed channel 15 up to the tip of the blade 16 leaning against the web 8.

The linear loading of the pre-doctoring blade 16 can be regulated by a load control device 19. The load control device 19 is preferably divided in the cross-direction of the web 8 into independent control sections, whereby the loading of the blade 16 can be varied in the cross-direction of the web 8, thus allowing for a way to control the amount of coating mix applied to obtain a desired coat weight profile in the cross-direction of the web 8. Due to the high feed velocity, typically exceeding 1 m/s, excess coating mix will spread upstream, toward the entry direction of the web 8. This excess coating mix is collected in a mix collecting trough (not shown). Furthermore, excess coating mix flowing over the blade 16 is collected in another mix collecting trough (not shown).

Figure 2:
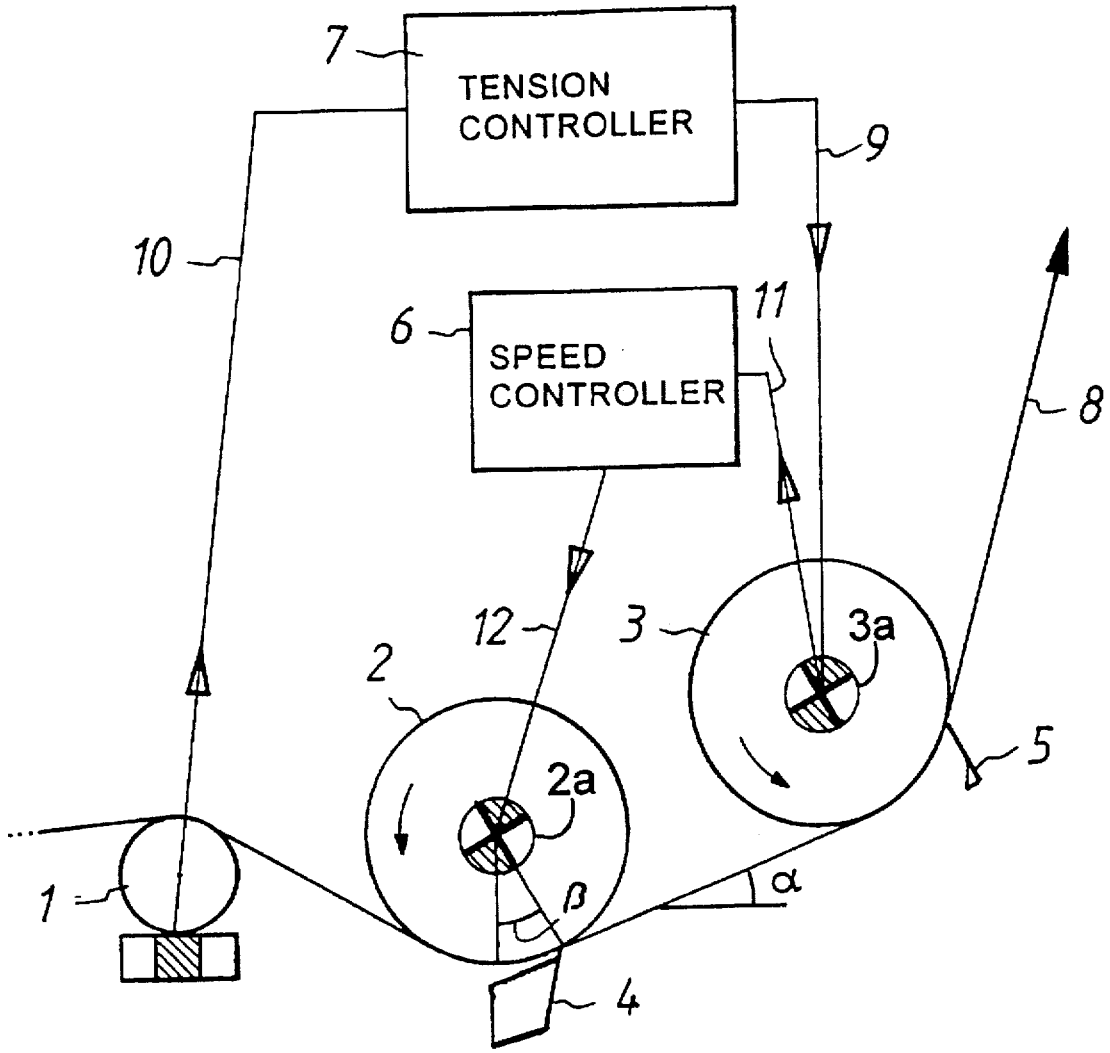
FIG. 2 is a block diagram of a control system in accordance with the present invention.

In FIG. 2, the method for controlling the tension between the backing rolls 2, 3 is described as a block diagram. The coating mix is applied to the web 8 by means of an applicator unit 4. The first backing roll 2, which, as shown, is a driven roll, supports the web 8 during the spreading of the coating mix. The application zone is marked as an angle$\beta$ on the first backing roll 2. From the application unit 4, the web 8 continues downstream to a doctoring unit, wherein it passes between a doctor blade 5 and the second backing roll 3, which is also a driven roll, as shown. At the doctoring unit, excess coating is scraped from the web 8, and the coating is smoothed and levelled to a desired coating weight.

A speed controller 6 preferably contains a microprocessor or other data processing device for storing and processing information and programs for calculating the speed difference between the backing rolls 2, 3 to maintain a desired tension of the web 8. The speed difference between the backing rolls 2, 3 is a function of several variables, $\Delta v=f(x, y, z \ldots)$, wherein the variables $(x, y, z \ldots)$ are, for example, weight per unit area of the paper, coating weight per unit area, tension of the web, difference in tension over the station, dry solids content of the coating mix, web speed, loading of the pre-smoothing blade and the doctor blade, and the time between application and doctoring, which is a function of web speed and distance between application and doctoring.

The system also includes a spreading/tension measurement roll 1 disposed upstream of the first backing roll 2 for measuring the tension of the web 8. The value of the tension of the web 8 measured by the tension measurement roll 1 is communicated by line 10 to a tension controller 7, wherein the initial web tension value is set. The tension controller 7 preferably contains a microprocessor or other data processing device. The tension controller 7 sets the rotational speed of the second backing roll 3 through line 9 which controls a means for driving 3*a* the second backing roll 3. The speed of the second roll 3 is then transmitted along line 11 to the speed controller 6 that calculates a proper speed difference between the first and second backing rolls 2, 3 and then transmits a speed control command along line 12 to the driving means 2*a* of the first backing roll 2. The rotational speed of the first roll 2 is now set according to the present conditions, and the speed difference between the first and the second backing rolls 2, 3 keeps the web 8 tensioned between these rolls 2, 3.

When the quality or type of the paper is changed, a new tension value is set in the tension controller 7, if needed.

Then, the new speed difference is selected in the speed controller 6. The new speed difference can be set manually or it can be chosen from a predetermined chart that can be stored in the memory of the speed controller 6 or the memory of a central data processing control system of the apparatus. Each paper quality requires a specific speed difference between the first and second backing rolls 2, 3 because the elongation caused by the wetting of the paper is different for different papers. The system can also be programmed to adapt automatically to changes in web speed, coat weight and other variables.

The use of an inverted blade applicator makes it possible to use a steel roll as the first backing roll 2. Also the exit angle α of the web 8 from the first backing roll 2 relative to horizontal can be very small, about 10° to about 30°, preferably about 15° to about 25°. Because no tension measurement roll is needed between the backing rolls 2, 3, the coating station can be very compact. Although a doctor blade 5 is shown, alternatively a rod or other scraping element may instead be used.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for coating a moving paper or cardboard web, comprising:

supporting a first portion of a first surface of the moving web against a rotating first backing roll;

applying coating mix to a second surface of the web opposite the first surface thereof by injecting a laminar flow of the coating mix onto a pre-doctoring blade, an edge of the pre-doctoring blade being proximate the second surface of the web and directly opposite the supported first portion of the first surface of the web, the coating mix being injected onto a side of the pre-doctoring blade counter to a direction of travel of the web;

smoothing the applied coating mix evenly on the web with the pre-doctoring blade;

supporting a second portion of the first surface of the moving web against a rotating second backing roll, the second portion of the moving web being downstream of the first portion of the web in the direction of travel of the web;

smoothing the coating mix applied to the second surface of the web using a doctoring means for smoothing the applied coating mix, the doetoting means being proximate the second surface of the web and directly opposite the supported second portion of the first surface of the web;

measuring tension of the web at a point upstream of the first backing roll;

continuously adjusting a speed of rotation of the second backing roll so that the tension of the web measured remains at a desired tension value; and continuously adjusting a speed of rotation of the first backing roll so that a rotational speed difference between the first and second backing rolls compensates for elongation of the web caused by application of the coating mix to the web.

2. The method of claim 1, wherein the coating mix is applied to the web at an angle of 20° or less relative to the second surface of the web at a point where the coating mix is applied to the web.

3. The method of claim 1, wherein at least one of the first and second backing rolls has a substantially non-deformable surface.

4. The method of claim 3, wherein the surface of at least one of the first and second backing rolls is comprised of steel.

5. The method of claim 1, wherein the first backing roll is positioned above the first portion of the first surface of the web and the second roll is positioned above the second portion of the first surface of the web.

6. A apparatus for coating a moving paper or cardboard web, comprising:

a rotatable first backing roll for supporting a first portion of a first surface of the moving web;

a means for applying coating mix to a second surface of the web opposite the first surface thereof, comprising a pre-doctoring blade and a channel for feeding the coating mix in a laminar flow onto said pre-doctoring blade, an edge of the pre-doctoring blade being proximate the second surface of the web and directly opposite the supported first portion of the first surface of the web so as to smooth the applied coating mix evenly on the web, said channel injecting the coating mix onto a side of said pre-doctoring blade counter to a direction of travel of the web;

a rotatable second backing roll for supporting a second portion of the first surface of the web, said second backing roll being positioned so that the second portion of the moving web is downstream of the first portion of the web in the direction of travel of the web;

a doctoring means for smoothing the coating mix applied to the second surface of the web, the doctoring means being proximate the second surface of the web and directly opposite the supported second portion of the first surface of the web;

a means for measuring tension of the web at a point upstream of said first backing roll;

a means for continuously adjusting a speed of rotation of said second backing roll so that the tension of the web measured remains at a desired tension value;

a means for determining a rotational speed difference between said first and second backing rolls;

a means for ascertaining a desired rotational speed difference between said first and second backing rolls to compensate for elongation of the web caused by application of the coating mix to the web; and a means for continuously adjusting the speed of rotation of said first backing roll to maintain the desired rotational speed difference between said first and second backing rolls determined by said determining means.

7. The apparatus of claim 6, wherein the coating mix is applied to the web at an angle of 20° or less relative to the second surface of the web at a point where the coating mix is applied to the web.

8. The apparatus of claim 6, wherein at least one of the first and second backing rolls has a substantially non-deformable surface.

9. The apparatus of claim 8, wherein the surface of at least one of the first and second backing rolls is comprised of steel.

10. The apparatus of claim 6, wherein the first backing roll is positioned above the first portion of the first surface of the web and the second roll is positioned above the second portion of the first surface of the web.

11. The apparatus of claim 6, wherein the web separates from a downstream side of said first backing roll at an exit angle of from about 10° to about 30° relative to horizontal.

12. The apparatus of claim 11, wherein the exit angle is from about 15° to about 25° relative to horizontal.

* * * * *